United States Patent [19]

Uryu

[11] Patent Number: 4,662,559

[45] Date of Patent: May 5, 1987

[54] FOLDING THICK PAPER BOX FOR (MENSTRUOUS) FILTHY GOODS AND SUPPORT STRUCTURE THEREOF

[76] Inventor: Kouhei Uryu, 1-7-1, Minami Ushiroya, Yashio-shi, Saitama 340, Japan

[21] Appl. No.: 778,035

[22] Filed: Sep. 20, 1985

Related U.S. Application Data

[63] Continuation-in-part of Ser. No. 635,683, Jul. 30, 1984, abandoned.

[30] Foreign Application Priority Data

| | | | |
|---|---|---|---|
| Jul. 29, 1983 | [JP] | Japan | 58-117098[U] |
| Dec. 20, 1983 | [JP] | Japan | 58-195024[U] |
| Dec. 20, 1983 | [JP] | Japan | 58-195025[U] |
| Jan. 20, 1984 | [JP] | Japan | 59-005151[U] |

[51] Int. Cl.[4] ..... B65D 5/10

[52] U.S. Cl. ..... 229/131; 206/806; 229/157; 229/44 R; 229/907

[58] Field of Search ..... 229/37 E, 39 R, 38, 229/45 R, 33, 44 R, 131, 160, 156, 157, 907; 248/311.2; 206/370, 380, 806

[56] References Cited

U.S. PATENT DOCUMENTS

| | | | |
|---|---|---|---|
| 1,530,643 | 3/1925 | Blandford | 229/44 R |
| 1,696,483 | 12/1928 | Hiering | 220/18 |
| 1,888,127 | 11/1932 | Hearne | 220/18 |
| 2,033,401 | 3/1936 | Schwab | 206/806 |
| 2,339,304 | 1/1944 | Von Haase | 206/806 |
| 2,451,644 | 10/1948 | Wood | 229/907 |
| 2,717,717 | 9/1955 | Busch | 220/18 |
| 2,754,991 | 7/1956 | Hagerty et al. | 220/18 |
| 2,964,228 | 12/1960 | Cote et al. | 229/44 R |
| 2,971,688 | 2/1961 | Akers | 229/907 |
| 3,007,177 | 11/1961 | Jackson et al. | 248/311.2 |
| 3,033,362 | 5/1962 | Marcalus | 206/806 |
| 3,110,467 | 11/1963 | Dube | 248/311.2 |
| 3,337,115 | 8/1967 | Jones | 229/39 R |
| 3,455,498 | 7/1969 | Gadiel | 229/907 |
| 3,658,236 | 4/1972 | Ringholm et al. | 229/907 |
| 3,900,059 | 8/1975 | Kirk et al. | 206/806 |
| 3,935,992 | 2/1976 | Uriu | 229/38 |
| 3,983,976 | 10/1976 | Taylor | 220/18 |
| 4,315,592 | 2/1982 | Smith | 229/907 |
| 4,421,267 | 12/1983 | Wischoff | 229/44 R |

FOREIGN PATENT DOCUMENTS

| | | | |
|---|---|---|---|
| 137195 | 9/1952 | Sweden | 229/44 R |
| 923284 | 4/1963 | United Kingdom | 229/39 R |

*Primary Examiner*—William Price
*Assistant Examiner*—Gary E. Elkins
*Attorney, Agent, or Firm*—Armstrong, Nikaido, Marmelstein & Kubovcik

[57] ABSTRACT

A paper box for collecting used sanitary cotton or the like. The box is composed of water proof thick paper and defined by two pairs of opposing vertical walls and a bottom composed of flaps continuously extending from the four vertical walls. A pair of retention flaps continuously extend from a first pair of opposing vertical walls at top edges thereof. Each retention flap is foldable inwardly and has a free end substantially parallel to said opposing two parallel vertical walls in the first pair. The free end is indented to form a first cutout. Form one of the opposing vertical walls in a second pair continuously extends a ramp flap. The ramp flap is foldable inwardly and has a pair of latch lugs. Each latch lug is arranged to fall into the cutout as the ramp flap is inwardly folded over the pair of retention flaps.

6 Claims, 33 Drawing Figures

FOLDING THICK PAPER BOX FOR (MENSTRUOUS) FILTHY GOODS AND SUPPORT STRUCTURE THEREOF

This application is a continuation-in-part application of U.S. patent application Ser. No. 635,683, filed 7-30-84, now abandoned.

BACKGROUND OF THE INVENTION

This invention relates to a disposable box made of thick paper, for collecting used sanitary cotton, paper etc. and more particularly to a disposable folding box for such menstruous filthy goods and the support structure thereof which is to be used in a toilet of, for example, hotel, department store, air port, etc.

Heretofore, a box for filthy goods of this type is made of an enameled iron plate or of a porcelain. Such box requires a cleaning job at least once in a day depending on how frequently it is used. Such cleaning job is much time and labour consuming. For example, it requires such elaborate job as checking whether a container is used or not, collecting a used container, taking out filthy goods from containers and disposing them, cleaning and disinfecting containers, distributing containers in toilets and so on. These jobs require not only much time and labour, but also, a person who engages in this kind of job is always bothered with upleasant feeling during the working time. Therefore, a labour charge for such person is necessarily high which in turn, results in burden, not so great though, or a neck for business operation in a sense.

SUMMARY OF THE INVENTION

The present invention was accomplished in view of the above.

It is therefore an object of the present invention to provide a disposable folding thick waterproof paper box for menstruous filthy goods with comparatively low costs.

Another object of the invention is to provide a folding thick waterproof paper box for menstruous filthy goods which can be obtained by user at a comparatively low price and therefore even if the box should be disposed after used, the overall costing could be less compared with the conventional container.

A further object of the invention is to provide a folding thick waterproof paper box for menstruous filthy goods which can be used with a least possible unpleasant feeling.

Still a further object of the present invention is to provide a folding thick waterproof paper box for menstruous filthy goods which can be made using comparatively less material without decreasing the containing capacity, thus decreasing the cost and weight within the range of that extent.

Another important object of the present invention is to provide a folding thick waterproof paper box which can be folded flat and piled up as many as, for example, 500 sheets or 1,000 sheets for easy transporation and/or maintenance, since the weight can be reduced as mentioned above.

A further object of the invention is to provide a folding thick waterproof paper box for menstruous filthy goods which is not opened unnecessarily excepting when in use, since the covering portion is provided with an insert portion for fastening, thus enabling to arrange and/or carry the box without much unpleasant feeling.

An even further object of the invention is to provide a folding cardboard box and a support structure thereof, wherein a support structure or a support board having a hanger at its front surface and an undry-bond at its back surface is provided in such a manner as that the box can be hung on the hanger so that the box can be handled more easily when in use compared with the case where a box is located directly on the floor, and wherein said support board can be used as a display board for advertisement or the like by printing characters and/or devices thereupon.

Another object of the present invention is to provide a folding thick waterproof paper box for menstruous filthy goods and a support structure thereof, wherein a lower vertical board constituting the support board is provided with a ball-like protrusion for fitting into a round hole and its connected elongated hole defined on the back board constituting the box body so that the hanging of the folding thick waterproof paper box can be enacted with sure and in an orderly manner.

In order to achieve the above object and others, there is essentially provided a folding thick waterproof paper box for (menstruous) filthy goods comprising a box body; a pair of retention flaps extending from the back and forth sides of the upper edges of said box body, said flaps each having approximately a half dimension of that of the box body in its plan shape and being provided with a substantially vertically elongated slit and a substantially horizontally elongated slit; a ramp flap extending from the left side of the upper portion of the box body and having a pair of insert portions at its free end sides each for inserting into said vertically elongated slit, said ramp flap having approximately a half dimension of that of the box body in its plan shape; and a cover flap consisting of a first section and a second section with a folding line therebetween and having substantially the same dimension as the box body in its plan shape, said cover flap extending from the right side of the upper portion of the box body, said covering flap having a pair of insert lugs each for inserting into said horizontally elongated slit, said lid lug including means for picking up thereof with fingers.

There is also provided a folding thick waterproof paper box for menstruous filthy goods comprising a box body; a pair of retention extending from the back and forth sides of the upper portions of said box body, said retention flaps each having approximately a fourth dimension of that of the box body in its plan shape and being provided with a substantially vertically elongated slit and a substantially horizontally elongated slit; a ramp flap extending from the left side of the upper portion of the box body and having a pair of insert portion at its free end sides each for inserting into said vertically elongated slit and provided with a slit at the center of the bottom portion of the ramp flap; said ramp flap having approximately a third dimension of that of the box body in its plan shape; and a cover flap consisting of a covering portion and a lid portion with a folding line formed therebetween and having approximately the same dimension as the box body in its plan shape, said cover flap extending from the right side of the upper portion of the box body, said covering portion having a pair of insert portion each for inserting into said horizontally elongated slit, said lid portion including an extrusion for inserting into the slit formed on the ramp flap.

There is also essentially provided a folding thick waterproof paper box for (menstruous) filthy goods and a support structure thereof comprising a box body; a pair of retention flaps extending from the back and forth sides of the upper portions of said box body, said retention flaps each having approximately a fourth dimension of that of the box body in its plan shape and being provided with a substantially horizontally elongated slit; a ramp flap extending from the left side of the upper portion of the box body and provided with a slit at the center of the bottom portion, said ramp flap having approximately a third dimension of that of the box body in its plan shape; a cover flap consisting of a first section and a second section with a folding line therebetween and having approximately the same dimension as the box in its plan shape, said cover flap extending from the right side of the upper portion of the box body, said first section having a pair of insert lugs each for inserting into said horizontally elongated slit, said second section including an extrusion for inserting into the slit formed on the guide board; and means for supporting the folding cardboard box.

There is also essentially provided a folding thick waterproof paper box for (menstruous) filthy goods and a support structure thereof comprising a box body including a back board which is provided with a pair of round holes and a pair of elongated holes formed immediately above said round holes for communication with respect to each other; a pair of retension flaps extending from the back and forth sides of the upper portions of said box body, said board each having approximately a fourth dimension of that of the box body in its plan shape and being provided with a substantially vertically elongated slit and a substantially horizontally elongated slit;

a ramp flap extending from the left side of the upper portion of the box body and having a pair of insert lugs at its free end sides each for inserting into said vertically elongated slit, said ramp flap having approximately a third dimension of that of the box body in its plan shape and being provided with a slit at the center of the bottom portion of the ramp flap; a cover flap consisting of a first section and a second section with a folding line formed therebetween and having substantially the same dimension as the box body in its plan shape, side cover flap extending from the right side of the upper portion of the box body, said covering section having a pair of insert portions each for inserting into said horizontally elongated slit, said second section including an extrusion for inserting into the slit formed on the ramp flap; and a support board consisting of a lower vertical board and an upper vertical board connected each other by way of a horizontal board which is connected to the upper portion of the lower vertical board at its one end and to the lower portion of the upper vertical board at its other end, said lower vertical board being provided with a pair of ball-like protrusions and a pair of foot-portions supporting said ball-like protrusions thereon on its front surface; said ball-like protrusions being inserted into the round holes, while said foot-portions being slidingly inserted into the elongated holes thereafter, said upper vertical board being provided with means for securing the box body to wall.

There is further provided a disposable paper box for collecting used sanitary cotton or the like comprising a box body of water proof thick paper, said body being defined by first and second pairs of opposing vertical walls and a bottom composed of flaps continuously extending from said four vertical walls at lower edges thereof; a pair of retention flaps continuously extending from said first pair of opposing vertical walls at top edges thereof, each retention flap foldable inwardly and having a free end substantially parallel to said opposing two parallel vertical walls in said first pair, said free end being indented to form a first cutout; and a ramp flap continuously extending from a first selected member of the opposing vertical walls in said second pair, said ramp flap being foldable inwardly and having a pair of latch lugs, each latch lug being arranged to fall into said cutout as said ramp flap is inwardly folded over said pair of retention flaps.

BRIEF DESCRIPTION OF THE DRAWINGS

FIGS. 1 to 13 illustrate one preferred embodiment of the present invention wherein;

FIG. 1 is a plan view showing the constitution of a pair of retention flaps, a ramp flap and a cover flap having first and second sections;

FIG. 2 is a front view of the above;

FIG. 3 is a plan view showing a second section of the cover flap closed when not in use;

FIG. 4 is a vertically sectional front view of the above;

FIG. 5 is a plan view showing said second section opened when in use;

FIG. 6 is a vertically sectional front view of the above;

FIG. 7 is a plan view of a modified embodiment of the second section;

FIGS. 8 to 13 illustrate another embodiment of the present invention wherein;

FIG. 8 is a plan view showing constitution of a pair of retention flaps, a ramp flap and a cover flap;

FIG. 9 is a side view of the above;

FIG. 10 is a plan view of the second section closed when not in use;

FIG. 11 is a vertical sectional view of the above taken on line XI—XI;

FIG. 12 is a plan view of the second section opened when in use;

FIG. 13 is a vertical sectional view of the above taken on line XIII—XIII;

FIGS. 14 to 21 illustrate a further embodiment of the present invention wherein;

FIG. 14 is a plan view showing the constitution of a pair of retention flaps, a ramp flap and a cover flap;

FIG. 15 is a side view of the above;

FIG. 16 is a plan view of the second section closed when not in use;

FIG. 17 is a vertical sectional view of the above taken on line XVII—XVII;

FIG. 18 is a plan view of the second section opened when in use;

FIG. 19 is a vertical sectional view of the above taken on line XIX—XIX;

FIG. 20 is a front view showing the box body hung on the hanger of a support board;

FIG. 21 is a plan view of the above;

FIGS. 22 to 30 illustrate a still further embodiment of the invention wherein;

FIG. 22 is a plan view showing the constitution of a pair of retention flaps, a ramp flap and a cover flap;

FIG. 23 is a rear view of the box body;

FIG. 24 is a plan view of the second section closed when not in use;

FIG. 25 is a vertical sectional view of the above taken on line XXV—XXV;

FIG. 26 is a plan view of the second section opened when in use;

FIG. 27 is a vertical sectionl view of the above taken on line XXVII—XXVII;

FIG. 28 is a front view showing the box body hung on the support board;

FIG. 29 is a side view of the above;

FIG. 30 is a vertical sectional view of the support board;

DETAILED DESCRIPTION OF THE EMBODIMENTS

Detailed description of preferred embodiments will be described hereinafter with reference to the accompanying drawings wherein like numerals denote like or corresponding parts throughout.

A preferred embodiment or first embodiment of the invention will be described in detail by referring to FIGS. 1 to 6.

1 denotes a box body. 2 denotes bottom of the known assemble-type comprising two or four flaps. 3 denotes a pair of retention flaps. 4 denotes a ramp flap and 5 denotes a cover flap. All these elements are made of thick paper which is waterproofed by means of wax-processing etc. and foldably processed by means of conventional art, such as perforated folding line processing or the like. The dimension of each of the retention flaps 3 and the ramp flap 4 is formed in approximately a half of that of the box body 1 in its plan shape. The cover flap 5 is formed in approximately the same dimension as the box body in its plan shape.

Each of said retention flaps 3 is formed with a substantially vertically elongated slit 3*a* on its left side and a substantially horizontally elongated slit 3*b* on its right side by means of conventional punching machine.

Figure 1:
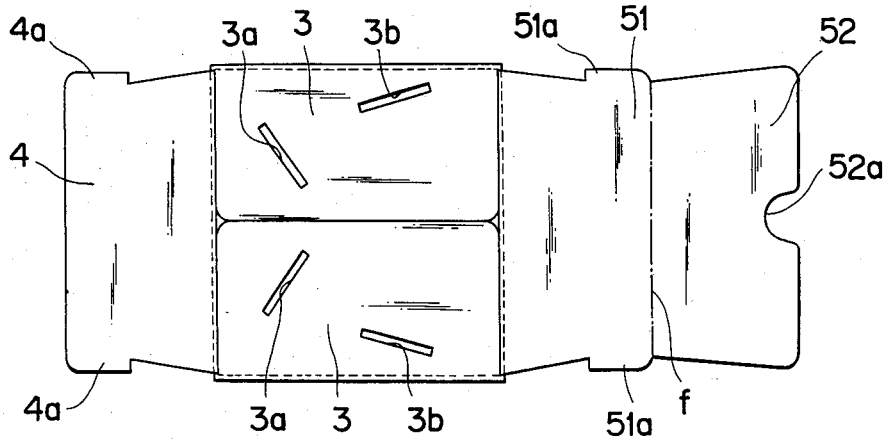
Figure 2:
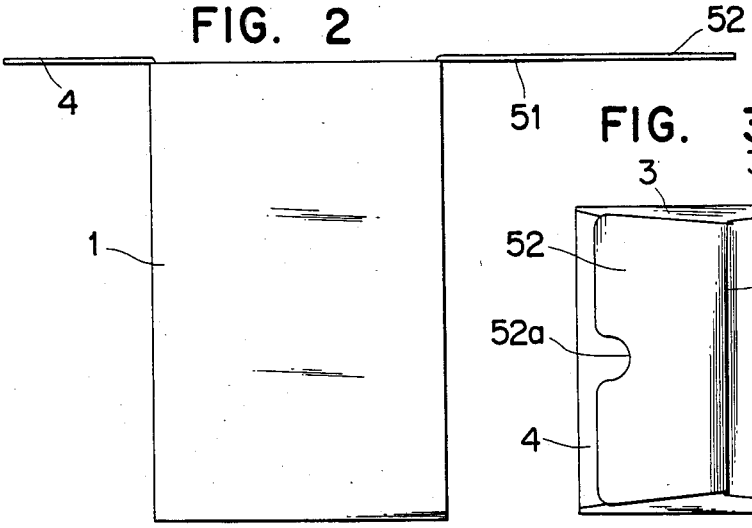

The ramp flap 4 is formed with a pair of insert lugs 4*a* at its free end sides as shown in FIG. 1. The cover flap 5 consists of a first section 51 and a second section 52 with a folding line f formed therebetween. The first section is formed with a pair of insert lugs 51*a* at the both corners thereof as shown in FIG. 1. The second section 52 is formed with an indented cutting-out 52*a* at the center of its right side.

Figure 3:
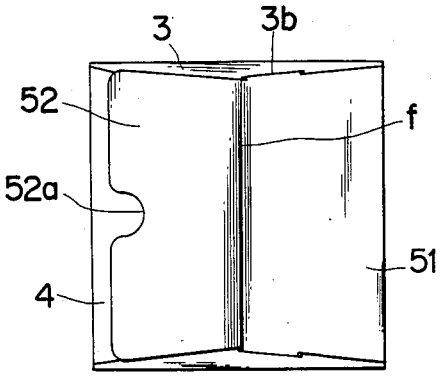
Figure 5:
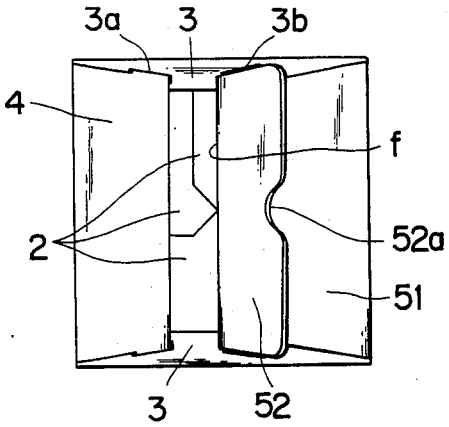
Figure 4:
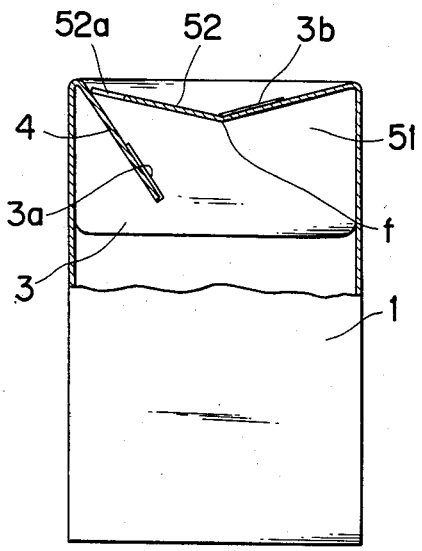
Figure 6:
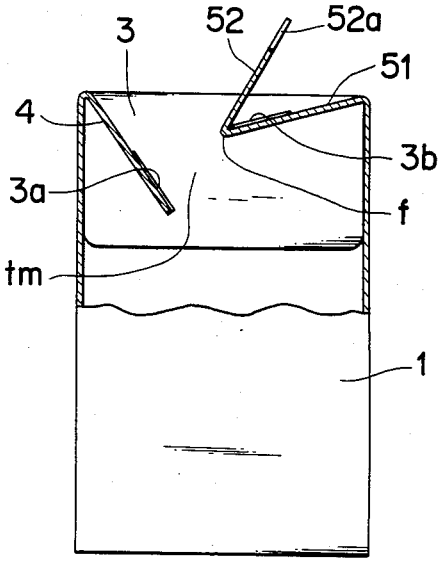
Figure 8:
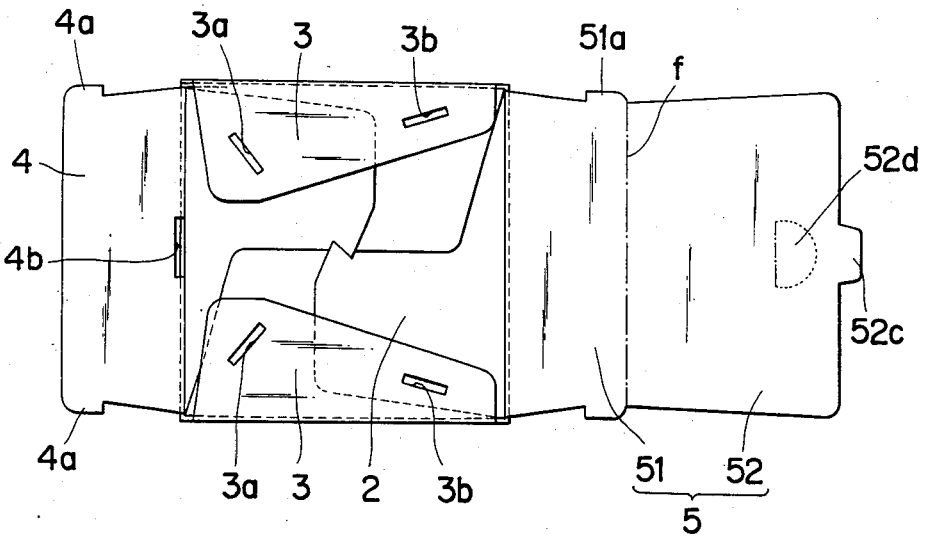
Figure 9:
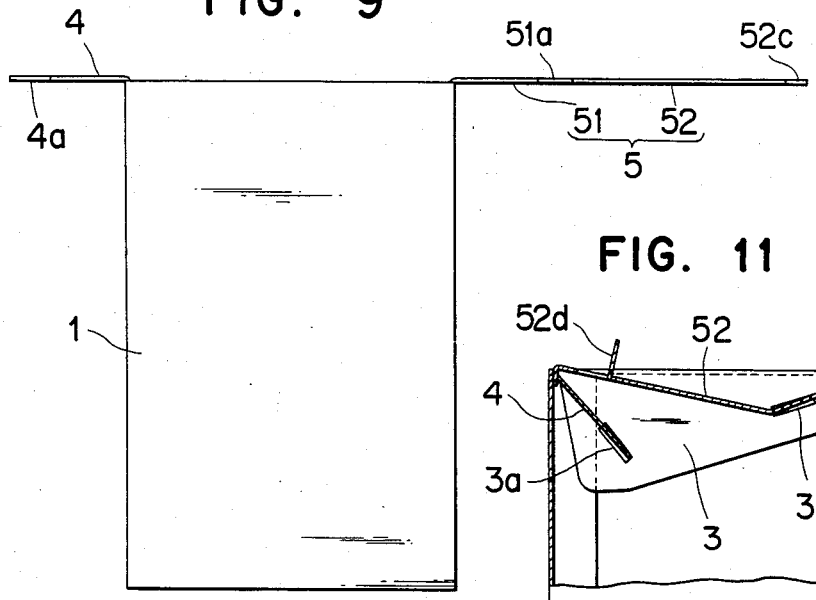
Figure 11:
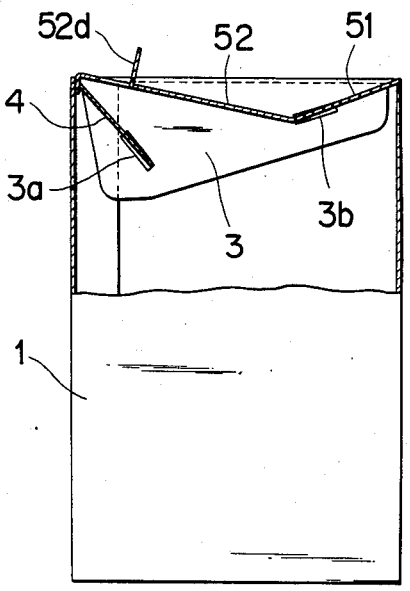
Figure 10:
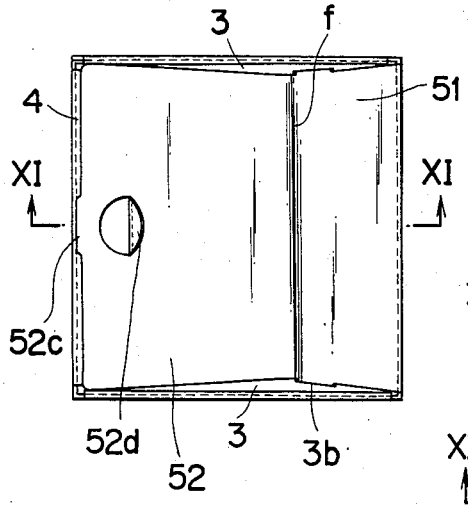
Figure 12:
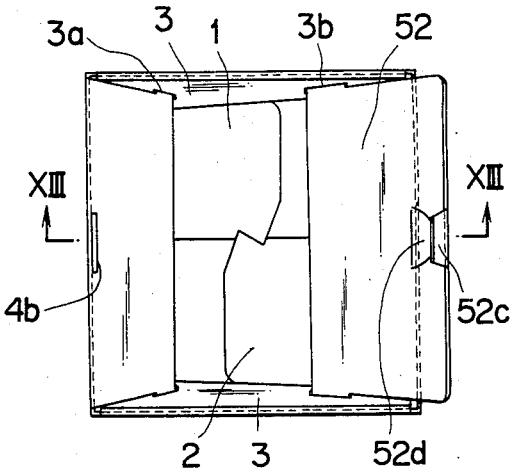
Figure 15:
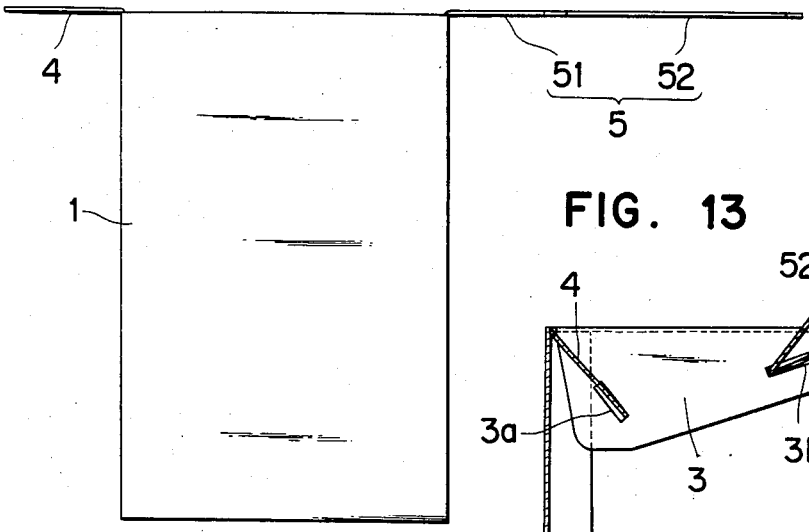
Figure 13:
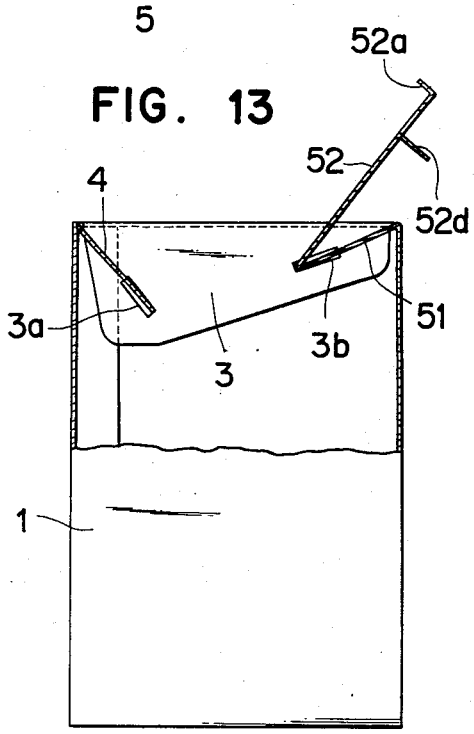
Figure 14:
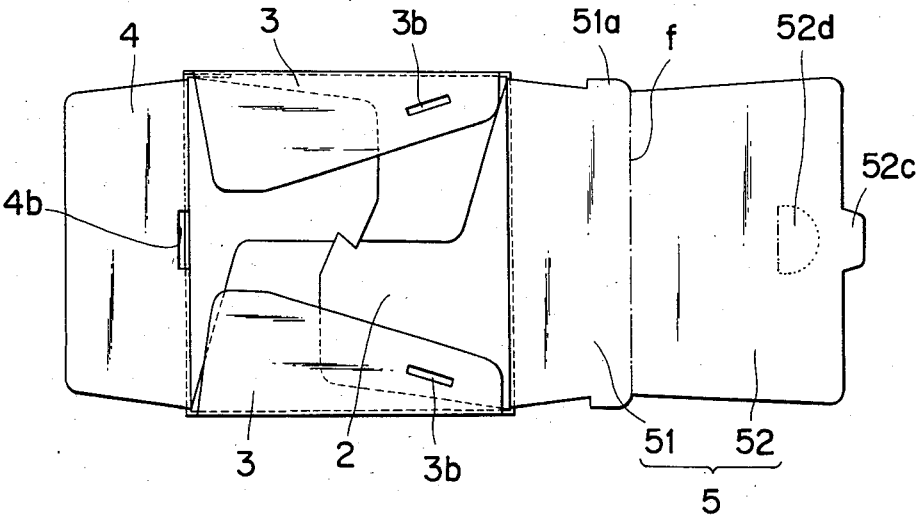
Figure 16:
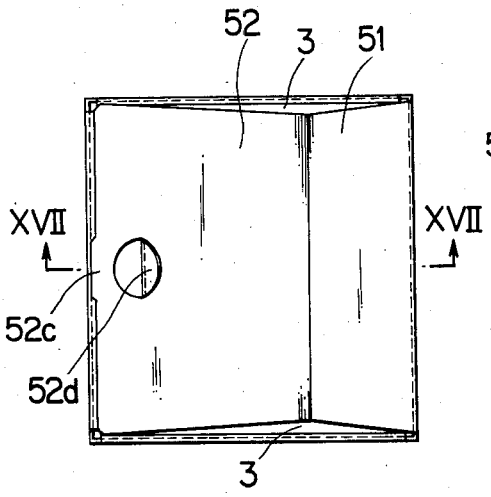
Figure 17:
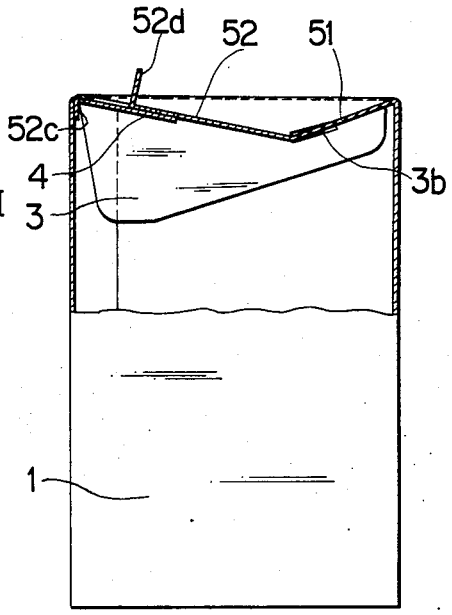

With the above-mentioned constitution, the retention flaps 3 are folded inwardly along the inner wall of the box 1. Then, the ramp flap 4 is also folded inwardly and the insert lugs 4*a* are inserted into said substantially elongated slits 3*a*, thereby allowing the ramp flap 4 to form a sharply declined configuration in section as shown in FIGS. 5 and 6. Thereafter, the first section 51 is folded inwardly in order to insert the insert lugs 51*a* into the substantially horizontally elongated slits 3*b*. The second section 52 is put on the ramp flap 4, when not in use, as shown in FIGS. 3 and 4. When in use, the second section 52 can be pulled up by inserting finger in the indented cutting-out 52*a*, as shown in FIGS. 5 and 6.

Figure 7:
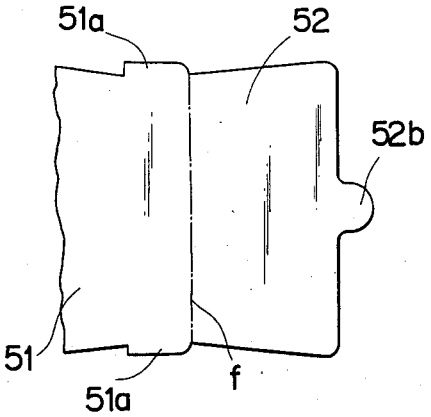

Although a preferred embodiment of the present invention was described above, the invention is not limited to the above. It may be constituted as follows:

(1) A round protrusion 52*b* may be formed instead of the indented cutting-out 52*a*, as shown in FIG. 7.

(2) A backing board or backing plate (not shown) may be provided on the bottom 2.

Since the present invention is constituted as in the foregoing, it can be manufactured at low costs. This means that users can obtain a box at a comparatively low cost. Therefore, even if a user should dispose the box after used, it is still economical for him when compared with a case using a conventional container. Furthermore, since the insert lugs are provided for fastening on the first sections of the cover flap, the box will not be opened unnecessarily, thus enabling to handle it without bothering from much unpleasant feeling.

Next, another embodiment or second embodiment of the present invention will be described by referring to FIGS. 8 to 13.

1 denotes a box body. 2 denotes bottom of the known assemble-type comprising two or four flaps. 3 denotes a pair of retention flaps. 4 denotes a ramp flap and 5 denotes a cover flap consisting of a first section 51 and a second section 52. Said pair of retention flaps 3 and said ramp flap 4 are connected to the upper edges of the box body 1. These are foldably constituted by using a board of the same material as in the first embodiment with approximately 0.5 mm thickness and by way of conventional art, such as punching process, folding line process, molding the box body after the end portions thereof is bonded, etc. Said ramp flap 4 is formed with insert lugs 4*a* at the end portions of the right and left sides for insertion into the vertically elongated slits 3*a* and is further formed with a slit 4*b* for said lid lug 52*c*.

The first section 51 and the second section 52 of the cover flap 5 are connected integrally by way of a folding line f. The first section 51 is formed with insert lugs 51*a* at the end portions of the right and left for insertion into said horizontally elongated slit 3*b*. The second section 52 is formed with an insert lug 52*c* at the center of the other side with respect to the folding line f for insertion into the slit 4*b* formed on the ramp flap 4. In this embodiment, a pick-up hole formed by machine is provided on the second section 52 in such a manner as to be erected when in use. However, this pick-up hole 52*d* can be eliminated.

With the above constitution, the folding of the box is made in the same manner as described with respect to the first embodiment and therefore, duplicated description will be avoided.

As mentioned above, since the pair of retention flaps and the ramp flap are reduced in their dimensional sizes, raw material to be used for making a box can be saved to some extent. As a result, costs for making a box can be down and weight can be reduced as well. As a result, when the boxes are folded flat and piled up, for example, 500 sheets or 1,000 sheets for transportation and/or maintenance, much easy handling can be obtained. Furthermore, since the box will be made available to user for a reduced price, a desirable disposable box can be attained, and no more cleaning job is required.

Now, another embodiment or third embodiment of the invention will be described with reference to FIGS. 14 to 21.

In this embodiment, the constitution of the box portion is same as that of the second embodiment excepting the following two differences;

(1) The ramp flap 4 is not formed with an insertion by 4*a*.

(2) The retention flaps are formed with the horizontally elongated slits 3b but not with the vertically elongated slits 3a.

Figure 20:
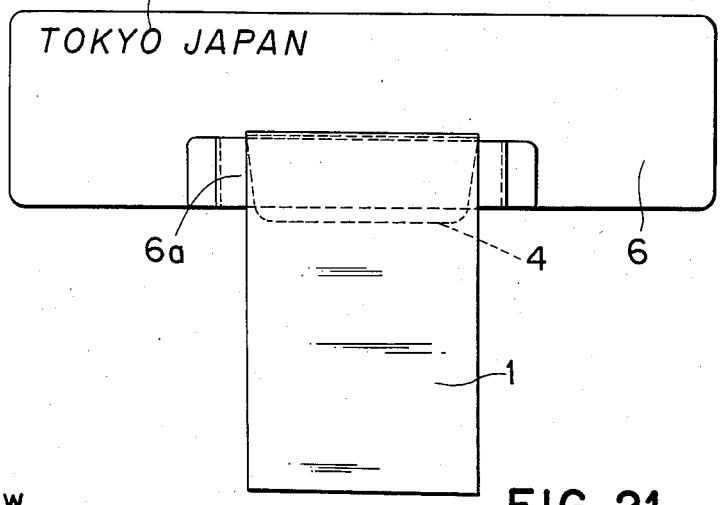
Figure 21:
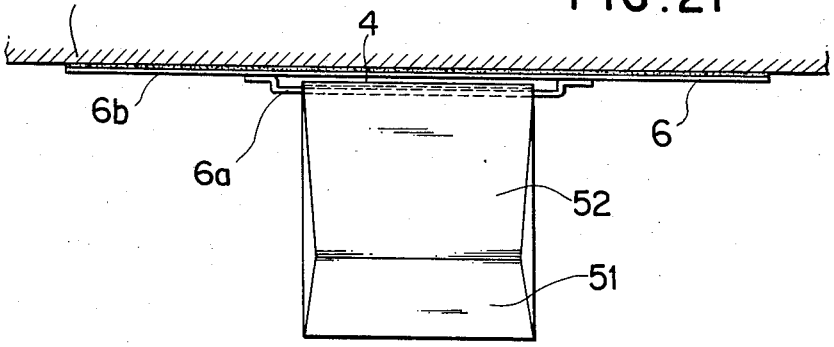
Figure 22:
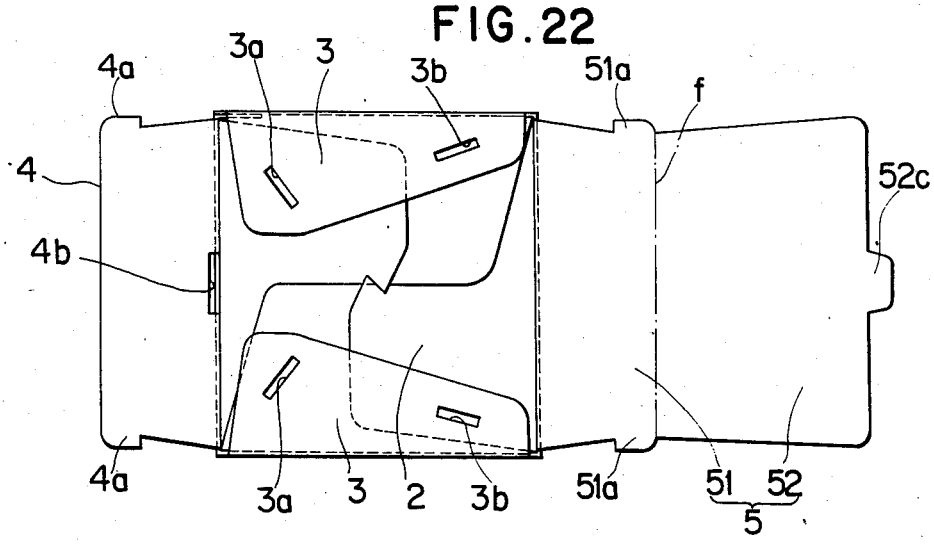

In FIGS. 20 and 21, 1 denotes a box body and 6 denotes a support board. A hanger 6a is mounted at the central lower portion on the surface of the support board 6. The support board 6 is applied with undry-bond 6b on its reversed surface. On the surface of the undry-bond 6b, a plastic film or a sheet is detachably provided. On the front surface of the support board 6, letters or devices 6c for advertisement are provided.

Figure 19:
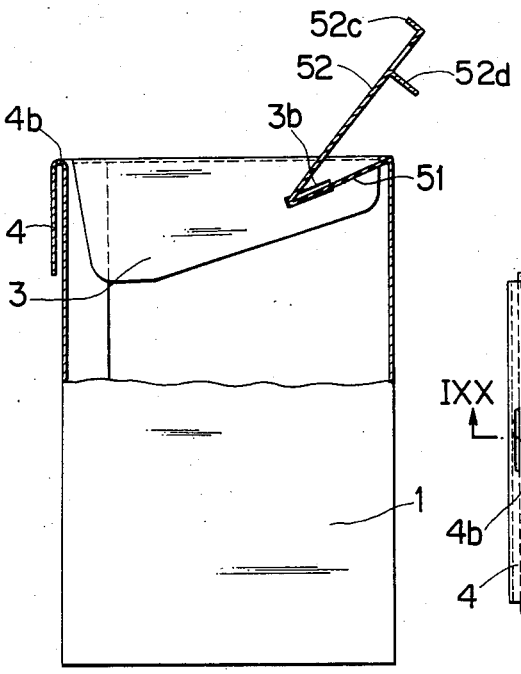
Figure 18:
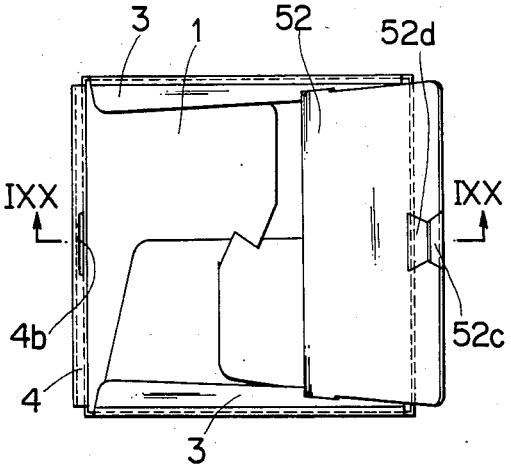

With the above constitution, the pair of retention flaps 3 are folded inwardly along the inner wall of the box body 1, and then the first section 51 of the cover flap 5 is folded inwardly and the insert lugs 51a are inserted into the horizontally elongated slits. Thereafter, the ramp flap 4 is folded outwardly, as shown in FIGS. 18 and 19. In this state, the box body 1 is hung on the hanger 6a. The support board 6 is firmly secured to a desired place on the wall w beforehand by means of the undry-bond 6b. In this state, the second section 52 is opened or closed, or the insert lug 52c is inserted into the slit 4b formed on the ramp flap 4, as shown in FIGS. 18 and 19. The pick-up 52d may be erected and used, if necessary.

Although a preferred embodiment was described above, the present invention is not limited to the above. For example, the support board 6 may be provided with an absorber using negative pressure.

With the above constitution, the present invention can offer the following advantages in addition to those already mentioned above.

Since the ramp flap of the box body can be hanged on the hanger mounted on the support board which is detachably secured to the wall, much easier handling can be obtained compared with the conventional container which is placed directly on the floor.

Another embodiment or fourth embodiment of the present invention will be described by referring to FIGS. 22 to 30.

With regard to the constitution of the box portion, it is practically same as that of the second embodiment, and therefore duplicated description will be avoided.

Figure 23:
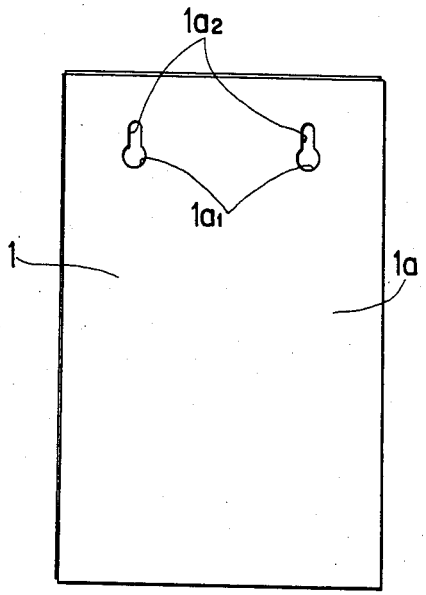

In FIG. 23, a back board 1a constituting a part of the box body 1 is formed with a pair of round holes 1a, and a pair of elongated holes formed immediately above the round holes for communication with respect to each other in order to hang the box body 1 on a support board 60 as will be described hereunder.

In FIGS. 28 to 30, 1 denotes a box body. 1a denotes a back board constituting a part of the box body 1. $1a_1$ denotes a pair of round holes and $1a_2$ denotes likewise a pair of elongated holes or retaining holes. 60 denotes the support board which comprises a lower vertical board 60a, and an upper vertical board 60c connected to the lower vertical board 60a by means of a horizontal board 60b. The lower vertical board 60a are formed with a pair of ball-like protrusions $60a_1$ at two places on its front surface in such a manner as that the protrusions $60a_1$ are protruded therefrom. The upper vertical board 60c is formed with a pair of mounting holes $60c_2$ two places thereon. 60b denotes letters and/or devices for advertisement provided on the upper vertical board 60c. $60c_1$ denotes a pair of machine screws and w denotes the wall.

Figure 24:
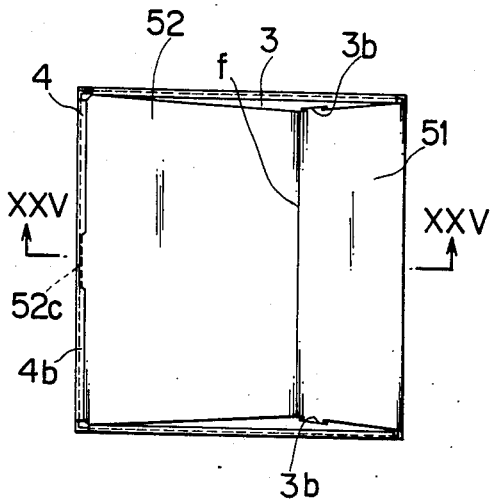
Figure 26:
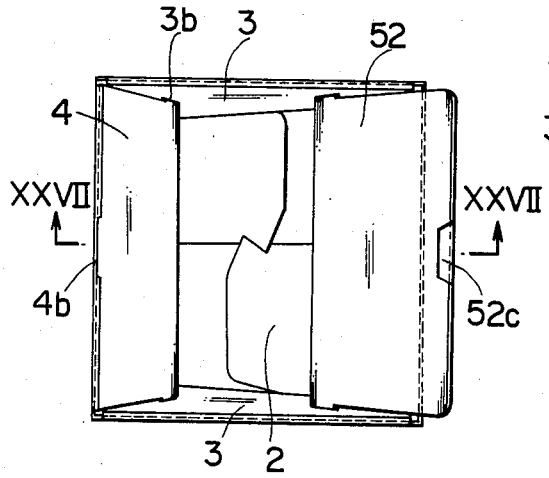
Figure 25:
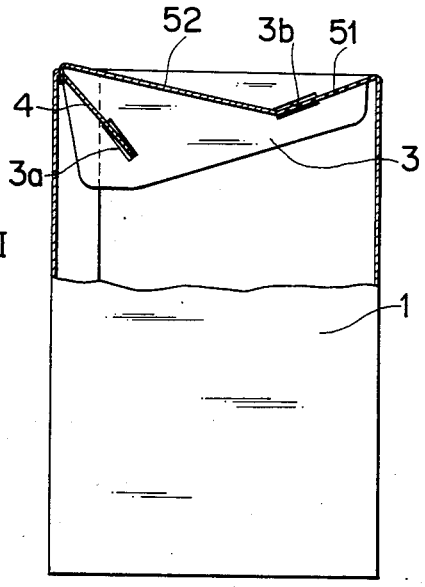

With the above constitution, the retention flaps 3 are folded inwardly along the inner wall of the box body 1. Then, the ramp flap 4 is folded inwardly and the insert lugs 4a are inserted into the vertically elongated slits 3a. Thereafter, the first section 51 of the cover flap 5 is folded inwardly and the insert lug 51a are inserted into the horizontally elongated slits formed on the retention flaps 3, and the insert lug 52c formed on the second section 52 is inserted into the slit 4b formed on the ramp flap 4, as shown in FIGS. 24 and 25. In the meantime, the support board 60 is firmly secured to the wall wa at a desirable place by means of the machine screws $60c_1$ through the mounting holes $60c_2$.

Figure 27:
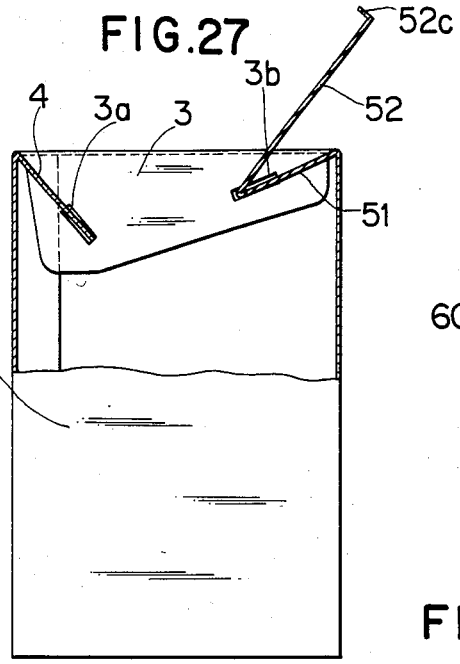
Figure 30:
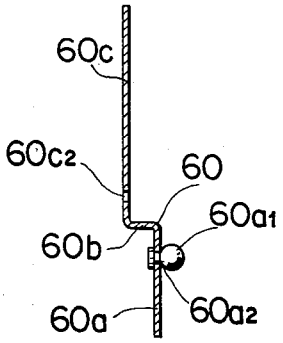
Figure 29:
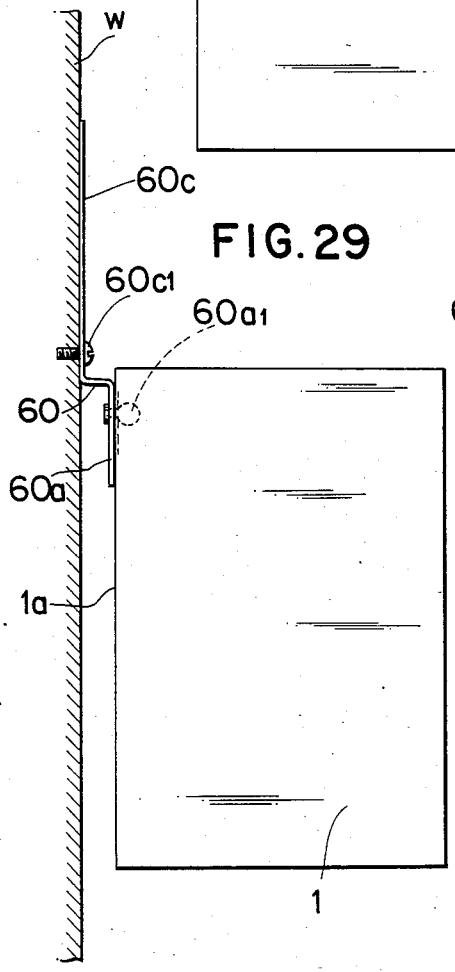
Figure 28:
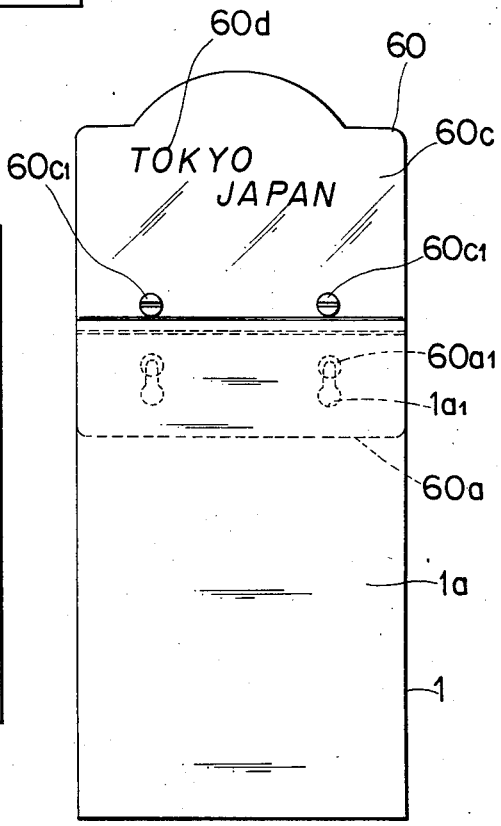

In the above state, the pair of the round holes $1a_1$ defined on the back board 1a of the box body 1 is fitted to the ball-like protrusions on the support board 60 and thereafter, the box body 1 is pulled down. In this way, the elongated holes $1a_2$ which are communicating with the round holes $1a_1$ are slidingly moved along the foot-portions $60a_2$ of the ball-like extrusions $60a_1$ and are retained at their dead ends. In this state, the second section 52 is closed or opened, as shown in FIGS. 25 and 27.

Although, a preferred embodiment of the invention was described above, the invention is not limited to the above. For example, the support board 60 may be secured to the wall w in the following manners:

(1) Instead of the mounting holes $60c_2$, undry-bond with holding sheet may be applied to the reversed surface of the upper verticle board 60c.

(2) The upper vehicle board 60c may be provided with an absorber using vacuum or negative pressure on its reversed surface.

With the above constitution the present invention can offer the following advantages in addition to those already mentioned above.

Because of the related constitution between the ball-like protrusions provided on the lower vertical board constituting a part of the supporting board and the round holes as well as the elongated holes communicating with respect to each other defined on the back board constituting a part of the box body, the hanging of the box body can be enacted with sure and in an orderly manner, and desirable letters and devices for advertisement can be provided on the vertical board which can be firmly secured to the wall.

Figure 31:
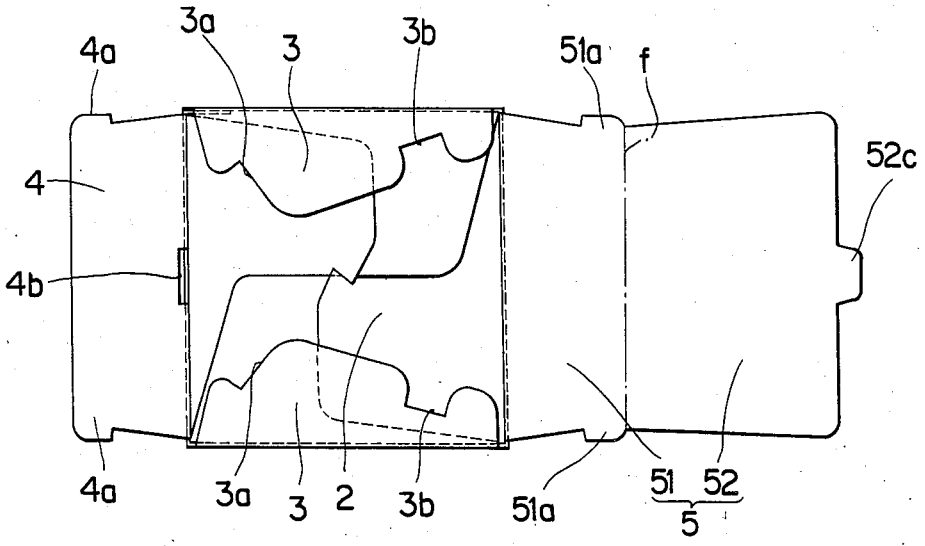
FIG. 31 is a plan view of a still further embodiment of the invention which shows a pair of retention flaps, a ramp flap and a cover flap.
Figure 32:
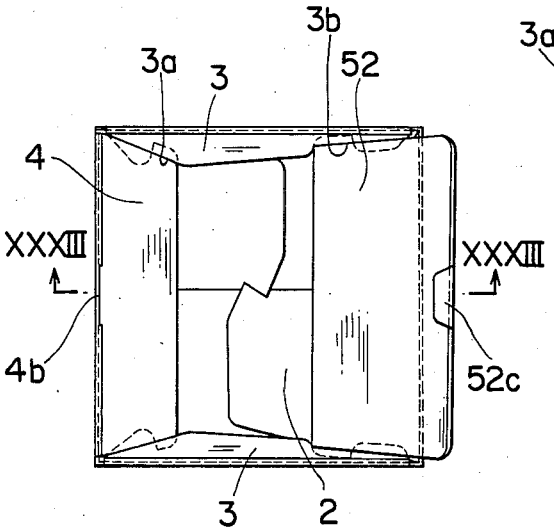
FIG. 32 is a view similar to FIG. 31, in which the retention flap, the ramp flap and the cover flap are folded into the entire box.
Figure 33:
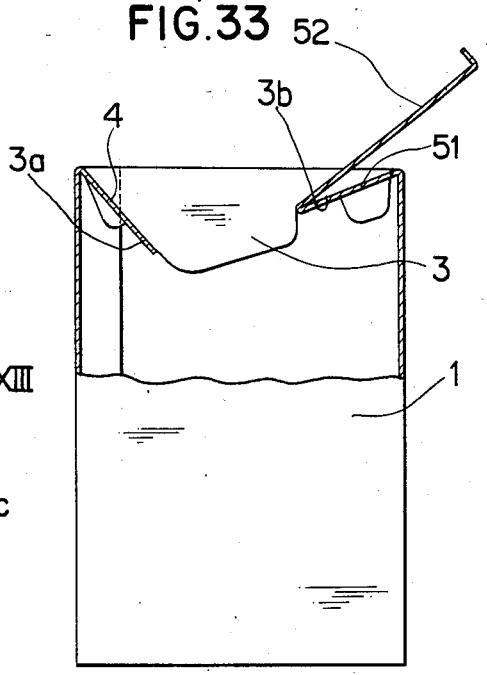
FIG. 33 is a cross sectional view of FIG. 32 taken along the line XXXIII—XXXIII.

Referring to FIGS. 31 to 33, there is shown a still further embodiment of the present invention. A box body 1 of water proof thick paper has two pairs of opposing vertical walls and a bottom composed of flaps continuously extending from said four vertical walls at lower edges thereof. From the top edges of the first pair of opposing vertical walls continuously extend a pair of retention flaps. Each retention flap 3 is foldable inwardly and has a free end remote from its corresponding vertical walls in a first pair and each free end is indented to form a first cutout 3a. From one of the remaining opposing vertical walls extend continuously a ramp flap 4. Said ramp flap 4 is foldable inwardly and have a pair of latch lugs 4a therein. When said ramp flap 4 is folded inwardly over the pair of retention flaps, each latch lug falls into said cutouts 3a.

There is further provided in the disposable paper box of this embodiment a cover flap 5 continuously extending from the other vertical wall. Said cover flap includes a first section 51 directly continuous from said the other vertical wall and a second section 52 continuous from the first section 51. Said first section 51 has a pair of latch lugs 51a. Again, the free end of each retention flap 3 is indented to form a second cutout 3b. When the first flap is folded inwardly over said pair of retention flaps 3, each latch lug 51*a* falls into said second cutout 3*b*.

Said second section 52 of the cover flap 5 can be folded outwardly as shown in FIGS. 32 and 33 such that used sanitary cotton or the like is discarded into the box along the ramp flap 4.

Since said cutouts 3*a* eliminate the need for troublesome insertion work of said latch lugs 51*a* thereinto, assembly work of the flaps can be done very quickly. Moreover, preciseness of the cutout arrangement is not required in the manufacture of the box.

What is claimed is:

1. A disposable paper box for collecting used sanitary cotton or the like comprising:

a box of water proof thick paper, said body being defined by first and second pairs of opposing vertical walls and a bottom composed of flaps continuously extending from said four vertical walls at lower edges thereof;

a pair of retention flaps continuously extending from said first pair of opposing vertical walls at top edges thereof, each retention flap foldable inwardly and having a free end remote from the corresponding vertical wall of said opposing two parallel vertical walls in said first pair of walls;

a ramp flap continuously extending from a first wall of said second pair of opposing vertical walls, said ramp flap being foldable inwardly;

a cover flap extending continuously from the top of a second wall of said second pair of opposing vertical walls, said cover flap being foldable inwardly and having a first portion and a second portion, said first portion being continguous with said second wall of said second pair of opposing vertical walls, and said second portion being continguous with said first portion and remote from said second wall of said second pair of opposing vertical walls;

wherein said ramp flap and said first portion of said cover flap each have a pair of latch lugs; and wherein each retention flap has means for retaining latch lugs from said ramp flap and said cover flap when folded inwardly to hold same in a fixed position, such that said ramp flap forms a substantially sharper angle with respect to its associated vertical wall then said first portion of said cover flap and such that the remote end of said ramp flap is lower than the remote end of the first portion of said cover flap.

2. A disposable paper box according to claim 1, wherein said second section of the cover flap is adapted to be folded outwardly.

3. The disposable paper box of claim 1, wherein said retaining means are two slits provided in each retention flap.

4. The disposable paper box of claim 3, wherein the two slits in each retention flap are positioned at different angles and heights on the retention flap.

5. The disposable paper box of claim 1, wherein said retaining means are two indentions in each retention flap to form cutout actions which are mutually engageable with said latch lugs.

6. The disposable paper box of claim 5, wherein said two indentations in each retention flap are positioned at different angles and heights on each retention flap.

* * * * *